US012781996B2

(12) United States Patent
Foos

(10) Patent No.: US 12,781,996 B2
(45) Date of Patent: Nov. 3, 2026

(54) MODULAR DAMPER SYSTEM WITH DOCKING MODULE AND BACKDRAFT DAMPER MODULE

(71) Applicant: Airware HVAC, Inc., Reno, NV (US)

(72) Inventor: Josh Foos, Reno, NV (US)

(73) Assignee: Airware HVAC, Inc., Reno, NV (US)

( * ) Notice: Subject to any disclaimer, the term of this patent is extended or adjusted under 35 U.S.C. 154(b) by 391 days.

(21) Appl. No.: 18/406,088

(22) Filed: Jan. 5, 2024

(65) Prior Publication Data

US 2025/0224135 A1 Jul. 10, 2025

(51) Int. Cl.
*F24F 13/14* (2006.01)

(52) U.S. Cl.
CPC ..... *F24F 13/1413* (2013.01); *F24F 13/1406* (2013.01)

(58) Field of Classification Search
CPC ..... F24F 13/1413; F24F 13/1406; F24F 13/0209; F24F 13/0254; F24F 2203/1096
USPC ..... 454/325, 257, 342, 357, 369
See application file for complete search history.

(56) References Cited

U.S. PATENT DOCUMENTS 2,135,810 A * 11/1938 Germonprez ..... F24F 13/075 49/51
4,558,892 A * 12/1985 Daw ..... F16L 23/14 285/424
5,460,348 A * 10/1995 Cox ..... F16M 5/00 248/237
6,953,320 B1 10/2005 Davis et al. ..... F24F 7/013 415/147
7,416,481 B2 8/2008 Baker et al. ..... H05K 7/20 454/184
10,514,181 B2 12/2019 Chappell et al. ..... F24F 7/00
10,816,237 B2 10/2020 Carey et al. ..... E06B 7/086
(Continued)

FOREIGN PATENT DOCUMENTS

CN 103123158 A * 5/2013 ..... F24F 7/06
CZ 6152 U1 * 8/1997

OTHER PUBLICATIONS

Kuran, Jozef, CZ6152 Translation.pdf, "Fire damper", Jun. 1997, pp. 1-7.*

(Continued)

*Primary Examiner* — Avinash A Savani
*Assistant Examiner* — Ryan L Faulkner
(74) *Attorney, Agent, or Firm* — Imperium Patent Works; Darien K. Wallace

(57) ABSTRACT

A damper system includes a backdraft damper frame, vertically oriented damper blades and a dock frame. A corner piece of the damper frame is attached to perpendicular first and second sides. A set screw passes through the corner piece at an axis that is not parallel to a damper plane defined by rear edges of the sides. The damper blades rotate into open and closed orientations. Portions of the damper blades extend beyond the damper plane when the damper blades are in the open orientation. A dock corner of the dock frame is attached to perpendicular third and fourth sides. The damper plane is parallel to a dock plane defined by front edges of the third and fourth sides. The dock corner has a set screw receiver that extends past the dock plane into the damper plane. The set screw from the corner piece enters into the set screw receiver.

20 Claims, 14 Drawing Sheets

(56) References Cited

U.S. PATENT DOCUMENTS

| | | | | |
|---|---|---|---|---|
| 2011/0028080 | A1 | 2/2011 | Hopkins et al. | F24F 13/14 454/259 |
| 2011/0028081 | A1 | 2/2011 | Hopkins et al. | F24F 13/10 454/259 |
| 2012/0108162 | A1* | 5/2012 | Willoquet | A62C 2/12 454/369 |
| 2013/0072103 | A1 | 3/2013 | Hopkins et al. | F24F 13/14 |
| 2015/0101697 | A1* | 4/2015 | Duffy | F24F 13/0209 138/109 |

OTHER PUBLICATIONS

Penlesky, Robert, CN103123158 Translation.pdf, "Ventilating system and method", May 2013, pp. 1-91.*

* cited by examiner

MODULAR DAMPER SYSTEM WITH DOCKING MODULE AND BACKDRAFT DAMPER MODULE

TECHNICAL FIELD

The described embodiments relate generally to an air handling system and, more particularly, to a modular docking system for a backdraft damper that prevents air from flowing, when the fan in not operating, in a direction opposite to the normal air flow created when the fan is operating.

BACKGROUND

Air handling systems, such as air conditioning and ventilation duct systems, typically include backdraft dampers (also called backflow prevention dampers) that allow air to flow in only one direction. A backdraft damper is opened by the air flow created by the fan and closes without any powered movement when the air ceases to be moved by the fan. Some dampers with horizontally oriented blades rely on gravity to close the blades when the air flow created by the fan stops and ceases to deflect the blades to an open orientation. A disadvantage of these horizontally oriented dampers is that a considerable amount of air flow is required to overcome the constant gravitational force tending to close the blades, which creates a drag and reduces the efficiency of the system.

Backdraft dampers with vertically oriented blades are also known, which do not lose efficiency due to having to counter the constant gravitational force tending to close the blades. Although the vertically oriented damper blades are initially opened by air flow through the damper, once the blades are opened they remain aligned with the air currents through the damper without creating any additional drag on the system. The damper blades are then closed by negative air pressure if air moves backwards through the damper, for example, as a result of a malfunctioning fan. A damper has a frame that supports the blades and that is installed next to the fan or in a duct. The frame becomes an air passage through which the air flow travels from the fan or to the fan.

A backdraft damper with vertically oriented blades is more efficient if it causes the least amount of drag on the air flowing through the air passage of the frame of the damper after the blades are initially moved to their best possible orientation. Each blade must have a stopper to prevent the blade from being deflected in the incorrect direction by air moving backwards through the system. Each blade must be stopped at some minimal angle that is canted from the local slip stream of the air flow to ensure that backwards moving air deflects the blade in the proper direction to entirely seal the air passage of the frame. Because the vertically oriented blades are canted at the minimal angle, any asymmetrical positioning of the blades relative to the center of the air passage will prevent the damper from achieving the minimal drag on the air flow through the damper.

The benefit of minimizing the drag on the air flow through the air passage of the frame is reduced if the damper is attached to the fan in a manner that leaks or that prevents smooth air currents without turbulence from passing through the blades. Typically, backdraft dampers are acquired separately from the fan or air handling system and are attached to the fan in an ad hoc manner. Fans usually have round openings corresponding to the circular orbit of the spinning fan blades. The damper frame that supports the damper blades is rectangular. Typically, the damper blades are wider than the damper frame is thick. So when the blades are open, they extend beyond the width of the damper frame. If the damper frame is mounted directly to the sheet metal back of the fan over the round opening to the fan, then the damper blades cannot completely open because they are hindered by the sheet metal surrounding the round hole. Thus, backdraft dampers are usually attached to the fan via a custom-made adapter that provides a spacing between the damper and the sheet metal of the fan for the damper blades to open. The custom-made adapters are typically hastily constructed in awkward locations and cause the air handling system to lose more efficiency due to leakage around the adapter than is gained by minimizing drag on the air flow through the damper.

A solution is sought for easily mounting a backdraft damper to its fan that provides sufficient spacing for the damper blades to open but yet that does not leak and is easy to install.

SUMMARY

A damper system includes a frame of a backdraft damper, a plurality of vertically oriented damper blades, a dock frame, and a set screw mount. Because the damper blades are oriented vertically in the damper frame, gravitational force does not move the damper blades into the open orientation or into the closed orientation. A corner piece of the damper frame is attached to first and second sides that are perpendicular to one another. A set screw passes through the corner piece at an axis that is not parallel to a damper plane that is defined by rear edges of the sides. The damper blades are adapted to rotate into an open orientation and a closed orientation. Portions of the damper blades extend beyond the damper plane when the damper blades are in the open orientation. A dock corner of the dock frame is attached to third and fourth sides that are perpendicular to one another. The damper plane is parallel to a dock plane defined by front edges of the third and fourth sides. The dock corner has a set screw receiver that extends past the dock plane into the damper plane. The set screw from the corner piece enters into the set screw receiver. The set screw is adapted to be retracted such that the set screw no longer enters into the set screw receiver. The set screw mount is attached to a plate of sheet metal of a fan assembly. A second set screw passes through the dock corner and has a screw axis that is not parallel to the dock plane. The screw axis is parallel to the axis of the set screw. The second set screw enters into the set screw mount. A gasket is disposed between the dock frame and the frame of the backdraft damper to prevent air from leaking out between the damper frame and the dock frame.

In another embodiment, a modular damper system includes a backdraft damper module and a docking module. The backdraft damper module includes a first damper frame side, a second damper frame side, a first frame corner, and vertically oriented damper blades. The first damper frame side is oriented perpendicular to the second damper frame side. A damper plane is defined by the rear edges of the first damper frame side and the second damper frame side. The first frame corner is disposed adjacent to a first end of the first damper frame side and adjacent to a second end of the second damper frame side. A first set screw passes through the first frame corner and has a first axis that is not parallel to the damper plane. The damper blades are adapted to rotate into an open orientation and a closed orientation. Portions of the damper blades extend beyond the damper plane when the damper blades are in the open orientation.

The docking module includes a first dock frame side, a second dock frame side, and a second frame corner. The second dock frame side is oriented perpendicular to the first dock frame side. A docking plane is defined by the front edges of the first dock frame side and the second dock frame side. The docking plane is parallel to and adjacent to the damper plane. The second frame corner is disposed adjacent to a third end of the first dock frame side and adjacent to a fourth end of the second dock frame side. The second frame corner has a set screw receiver that protrudes past the damper plane and into the backdraft damper module. The first set screw enters into the set screw receiver. The first set screw is adapted to be retracted from the set screw receiver.

The modular damper system also includes a set screw mount that is adapted to be attached to the sheet metal plate of a fan assembly. A second set screw passes through the second frame corner and has a second axis that is not parallel to the docking plane. The second set screw enters into the set screw mount. The second axis of the second set screw is parallel to the first axis of the first set screw.

Other embodiments and advantages are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

Figure 1:
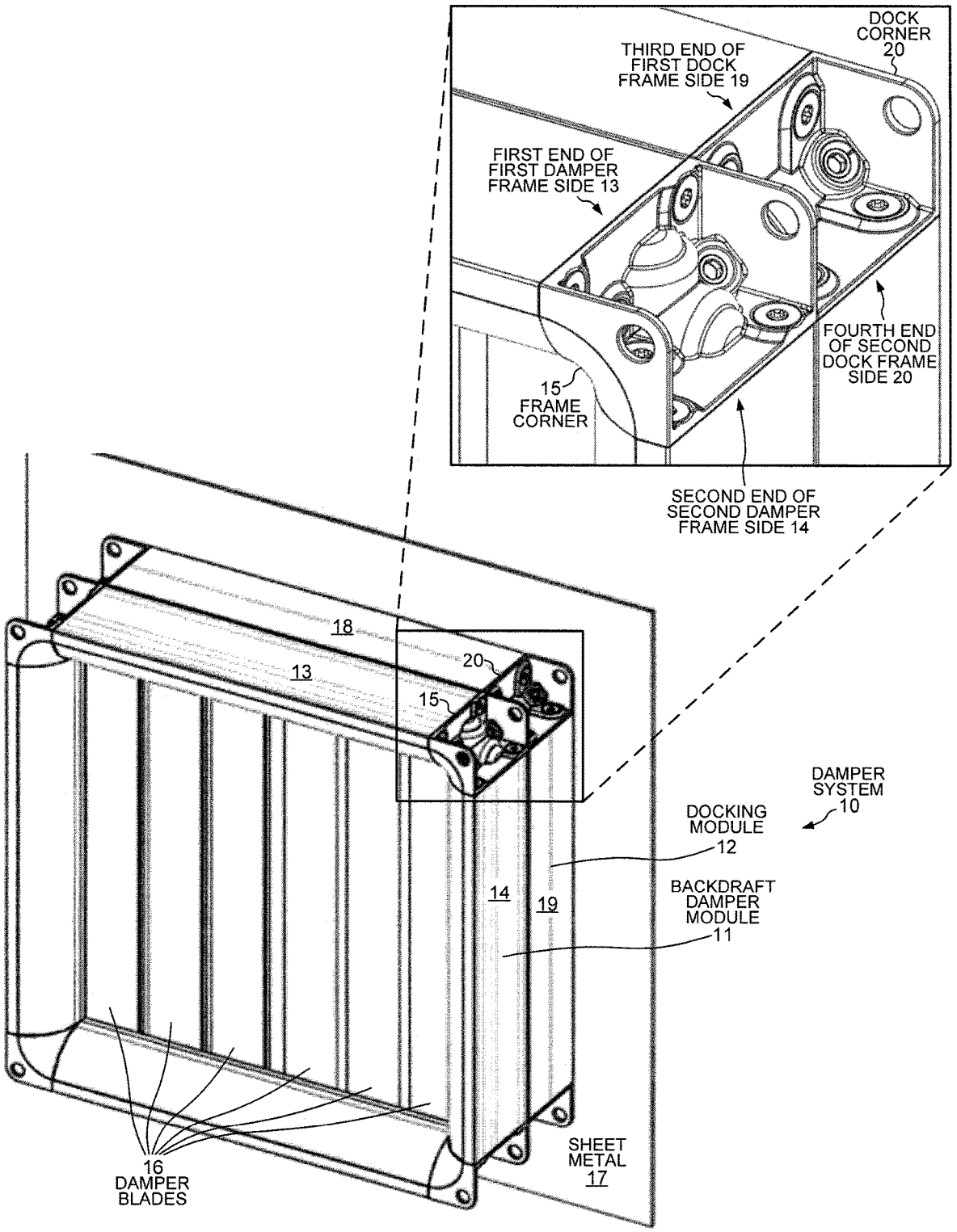
FIG. 1 is a perspective view of a modular damper system that includes a backdraft damper module and a docking module.

FIG. 1 is a perspective view of a damper system 10 that includes a backdraft damper module 11 and a docking module 12. The frame of the backdraft damper module 11 is formed by four damper frame sides that are connected by four frame corners. The sides can be made of extruded aluminum, and the corners can be made of cast stainless steel. For example, a first damper frame side 13 is connected to a second damper frame side 14 by a first frame corner 15. The backdraft damper module 11 is rectangular, and the first damper frame side 13 is oriented perpendicular to the second damper frame side 14. The first frame corner 15 is disposed adjacent to a first end of the first damper frame side 13 and adjacent to a second end of the second damper frame side 14.

The backdraft damper module 11 includes an even number of damper blades 16 that are oriented vertically in the frame. The damper blades 16 are adapted to rotate to an open orientation and to a closed orientation depending on the air flow traveling through the backdraft damper module 11. The blades 16 are shown in the closed orientation in FIG. 1.

The docking module 12 is disposed between the backdraft damper module 11 and a plate of sheet metal 17. The sheet metal 17 is attached to a fan of an air handling system, such as air conditioning system or a ventilation duct system. The frame of the backdraft damper module 11 is adapted to allow air drawn by the fan to flow through the damper blades 16. In FIG. 1, air is not being drawn by the fan because the damper blades 16 are closed. The frame of the docking module 12 is formed by dock frame sides that are connected by frame corners. For example, a first dock frame side 18 is connected to a second dock frame side 19 by a second frame corner 20. The docking module 12 is rectangular, and the first dock frame side 18 is oriented perpendicular to the second dock frame side 19. The second frame corner 20 is disposed adjacent to a third end of the first dock frame side 18 and adjacent to a fourth end of the second dock frame side 19.

Figure 2:
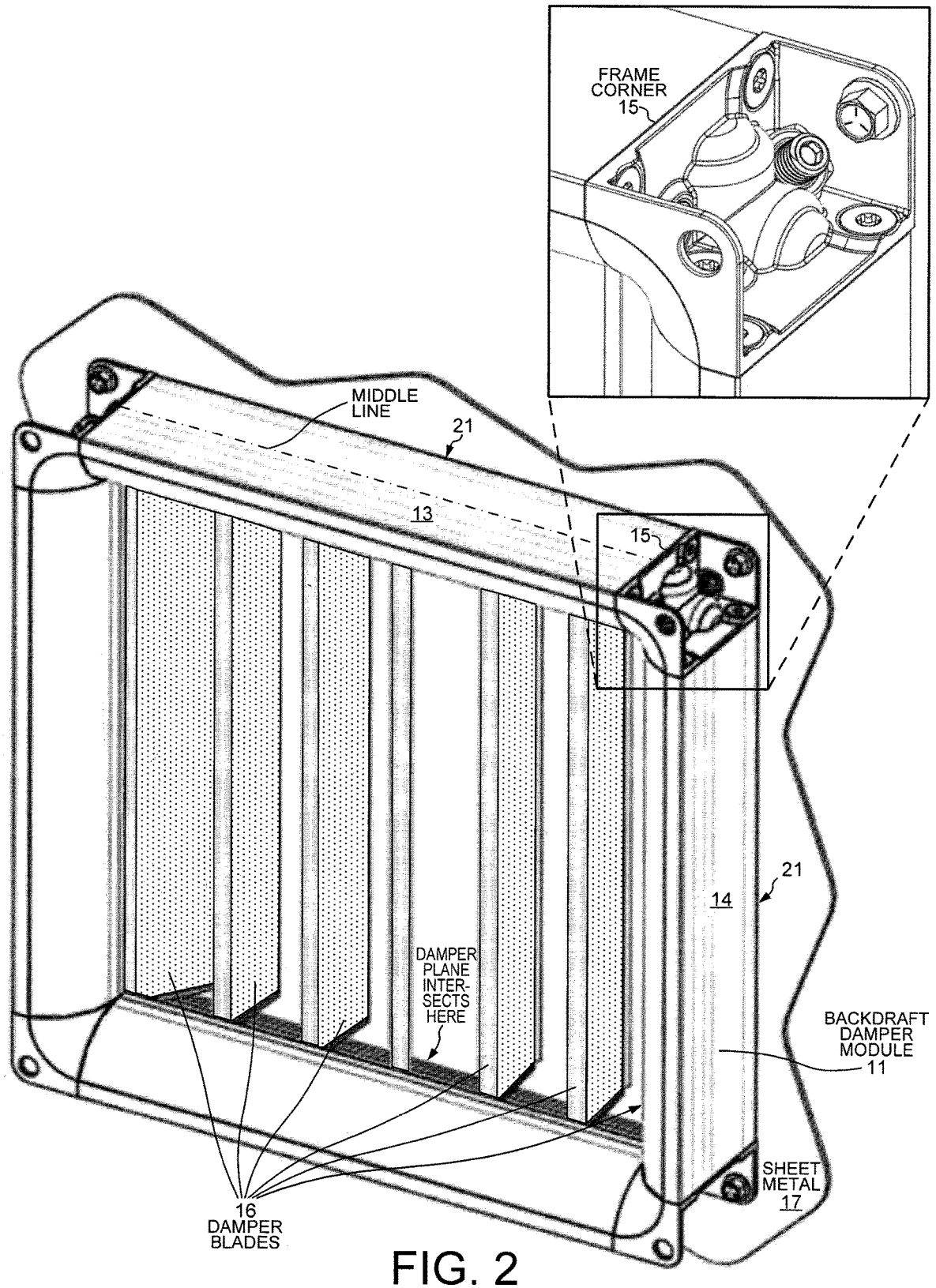
FIG. 2 shows a backdraft damper module attached directly to the sheet metal plate of a fan assembly.

FIG. 2 shows the backdraft damper module 11 attached directly to sheet metal 17 of a fan assembly. There is no docking module between the damper and the sheet metal in the configuration of FIG. 2. A damper plane is defined by rear edges 21 of the first damper frame side 13 and the second damper frame side 14. The damper plane is adjacent to the plane of the plate of sheet metal 17. Each damper blade rotates about a vertical axis that passes through a long side of the blade. The axes of rotation of the blades 16 intersect a line that passes longitudinally through the middle of the first damper frame side 13. The first damper frame side 13 is three inches wide. The damper blades 16 have widths of either two inches or two and a half inches, so the blades are at least two inches wide. Therefore, when the damper blades 16 rotate into an open orientation, as shown in FIG. 2, the blades extend beyond the damper plane by at least one half inch.

Unless there is a rectangular opening in the sheet metal 17 of the fan assembly that is at least as large as the inside of the frame of the backdraft damper module 11, the damper blades 16 will be prevented from opening by the sheet metal 17. Because fan assemblies are typically mounted to plates that have round openings corresponding to the circular orbit of the spinning fan blades, the damper blades 16 must be offset from the sheet metal of the fan plate so that the blades 16 are not hindered from rotating to an open orientation by the sheet metal surrounding the round hole. The docking module 12 in the damper system 10 of FIG. 1 provides the spacing or offset from the sheet metal 17 that is required to allow the damper blades 16 from rotating to their open orientation.

The docking module 12 provides a modular component to the damper system 10 that can quickly and easily be installed between the backdraft damper module 11 and the sheet metal plate of the fan assembly. The docking module 12 is attached to the damper module 11 by complementary connectors on the frame corner 15 and dock corner 20 that allow the frame corner 15 to be nested in the dock corner 20. The modular design with complementary connectors allows additional docking modules to be installed between the damper module 11 and the sheet metal 17 in order to increase the spacing between the fan and the damper.

Figure 3:
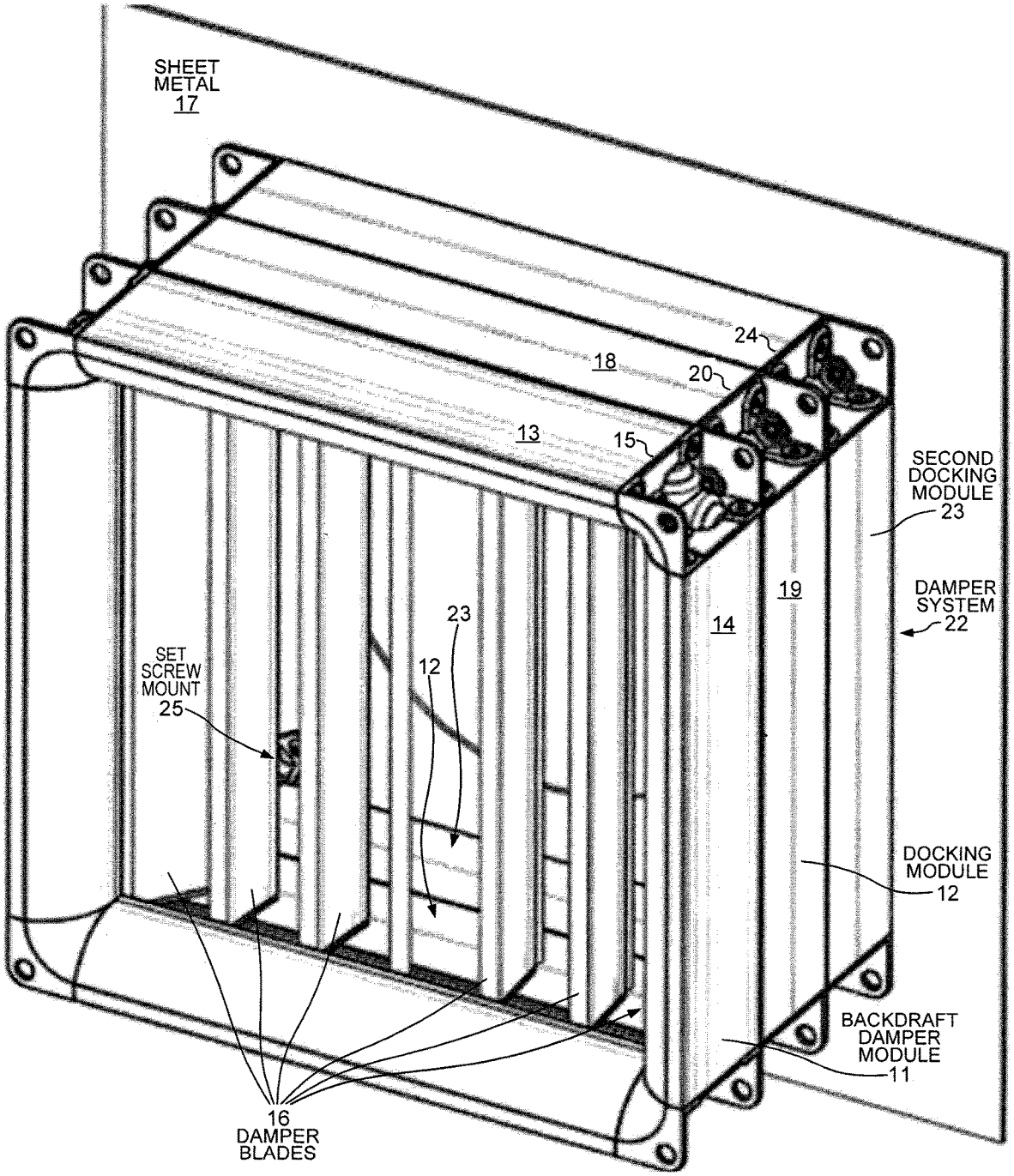
FIG. 3 is a perspective view of a modular damper system that includes a backdraft damper module and two docking modules.

FIG. 3 is a perspective view of a damper system 22 that includes backdraft damper module 11, docking module 12 and a second docking module 23. In FIG. 3, a circular opening in the sheet metal 17 through which air is drawn in by the fan is visible through the damper blades 16. The second docking module 23 is attached to the docking module 12 by complementary connectors on the dock corner 20 and a second dock corner 24 that allow the dock corner 20 to be nested in the second dock corner 24. The second dock corner 24 has the same shape as the dock corner 20. The second docking module 23 in the damper system 22 of FIG. 3 provides an additional offset from the sheet metal 17 that allows the damper blades 16 to be unobstructed by any guard or fan cone that might protrude out from the fan assembly beyond the plane of the plate of the sheet metal 17 towards the backdraft damper module 11. The additional spacing between the plane of the sheet metal 17 and the backdraft damper module 11 can also be used to accommodate ultraviolet (UV) light sources that sanitize and sterilize the air passing through the damper system 22. In addition, other air monitors and sensors can also be accommodated in the space between the plane of the sheet metal 17 and the backdraft damper module 11, such as sensors for the size and amount of particulate matter in the air flowing through the damper system 22.

FIG. 3 also shows a portion of a set screw mount 25 that is visible through two of the damper blades. The set screw mount 25 is attached to the sheet metal 17. The four docking corners of the second docking module 23 are attached to the plate of the sheet metal 17 via four set screw mounts, such as set screw mount 25.

Figure 4:
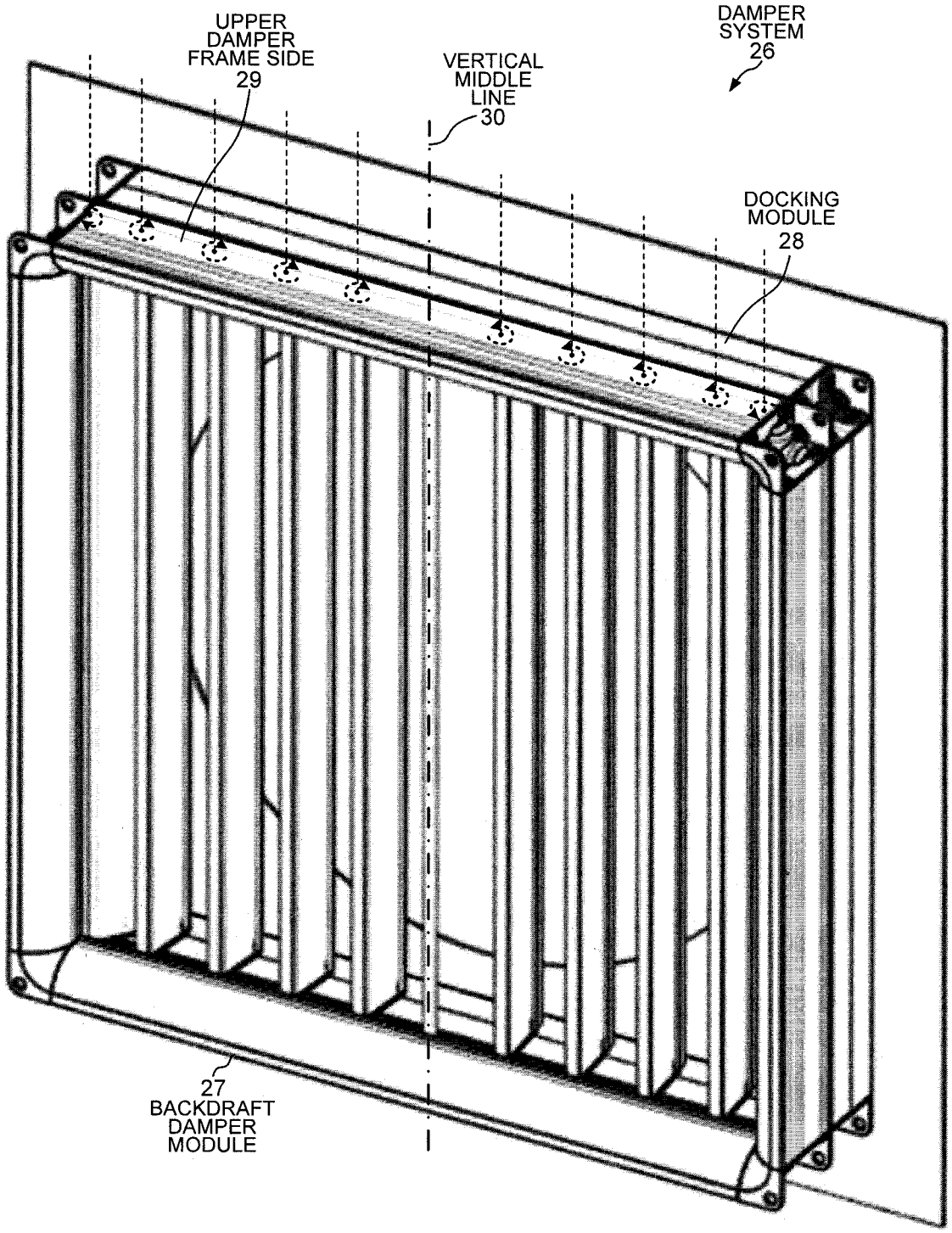
FIG. 4 shows a damper system that includes a docking module and a 24-inch by 24-inch backdraft damper module with ten vertically oriented damper blades.

FIG. 4 shows a perspective view of a damper system 26 that includes a backdraft damper module 27 and a docking module 28. The frame of the backdraft damper module 27 is formed by four frame corners that connect four damper frame sides, including an upper damper frame side 29. The backdraft damper module 27 has an even number of vertically oriented damper blades, just as does the backdraft damper module 11 of damper system 10. Moreover, the damper blades are also arranged at symmetrical locations on either side of a vertical middle line 30 through the backdraft damper module. A stopper is integrated into the upper damper frame side 29 for each damper blade that prevents the blade from being deflected in the incorrect direction by air moving backwards from the fan to the backdraft damper module 27. Each blade is stopped at some minimal angle (e.g., five degrees) that is canted from the local slip stream of the air flow at the location of the blade to ensure that backwards moving air deflects the blade in the proper direction to ensure that the blades to the right of middle line 30 rotate counter-clockwise, and the blades to the left of middle line 30 rotate clockwise to completely seal the air passage of the frame. Because the vertically oriented blades are canted at some minimal angle, any asymmetrical positioning of the blades relative to the center of the damper module will prevent the damper from achieving the minimal drag on air flow and the minimal air pressure drop across the damper.

Figure 5:
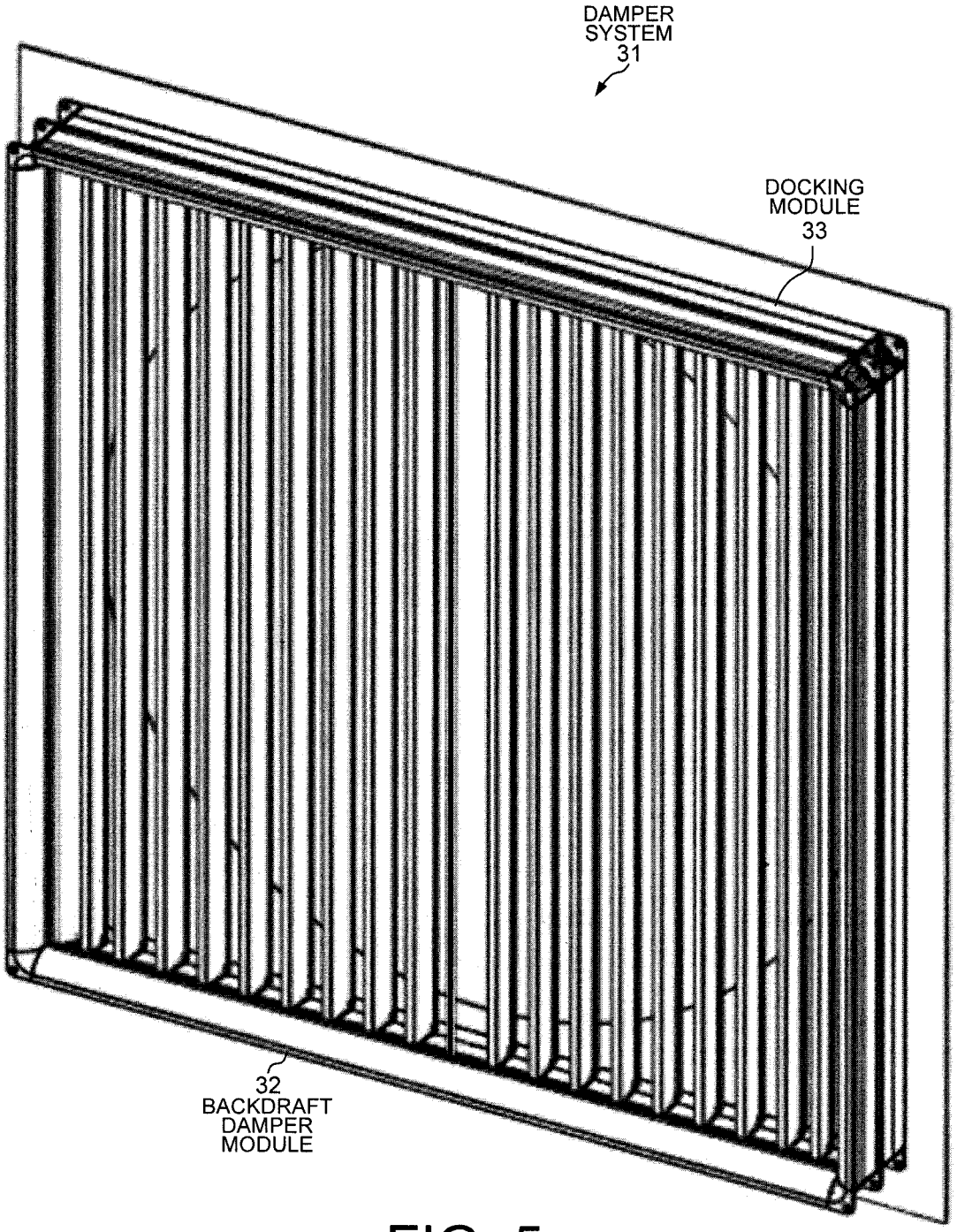
FIG. 5 shows a damper system that includes a docking module and a 48-inch by 48-inch backdraft damper module with twenty vertically oriented damper blades.

FIG. 5 shows a perspective view of a damper system 31 that includes a backdraft damper module 32 and a docking module 33. The backdraft damper module 32 has twenty vertically oriented damper blades arranged at symmetrical locations on either side of the vertical middle line through the backdraft damper module. The backdraft damper module 32 has an inner dimension of the frame of 48 inches by 48 inches. In comparison, the backdraft damper module 11 of damper system 10, as shown in FIG. 1, has six damper blades 16 and an inner dimension of the frame of twelve inches by twelve inches. In comparison, the backdraft damper module 27 of damper system 26, as shown in FIG. 4, has ten damper blades and an inner dimension of the frame of 24 inches by 24 inches. Each of the damper systems 10, 26 and 31 can be manufactured using damper blades having only widths of two inches and/or two and a half inches. In fact, square backdraft damper modules having an inner frame side dimension in one-inch increments ranging from twelve inches through 58 inches can be made using just these two sizes of damper blades: two inches and/or two and a half inches.

For example, the 12-inch square backdraft damper module 11 of damper system 10, as shown in FIG. 1, has three damper blades on either side of the vertical middle line, and each of the blades has a width of two inches. The 24-inch square backdraft damper module 27 of damper system 26, as shown in FIG. 4, has four damper blades on either side of the vertical middle line that are each two and a half inches wide, plus a fifth damper blade on the outsides that has a width of two inches. Each side has a combined width of twelve inches. (12=(4×2.5)+2) The 48-inch square backdraft damper module 32 of damper system 31, as shown in FIG. 5, has eight damper blades on either side of the vertical middle line that are each two and a half inches wide, plus a ninth and a tenth damper blade on the outsides that have widths of two inches. Each side has a combined width of 24 inches. (24=(8×2.5)+(2×2)) The damper systems 10, 26 and 31 are three examples of square backdraft damper modules having square inner frame dimensions in one-inch increments from twelve inches through 58 inches that can be made in a standardized manner using just two blade widths, two inches and/or two and a half inches. For example, a 12-inch damper can be made using six 2-inch wide blades. A 13-inch damper can be made using two 2.5-inch blades and four 2-inch blades. A 14-inch damper can be made using four 2.5-inch blades and two 2-inch blades. And a 15-inch damper can be made using six 2.5-inch blades. In one embodiment of the method, the 2-inch wide blades are disposed farther from the middle line, and the 2.5-inch wide blades are disposed closer to the middle line.

Figure 6:
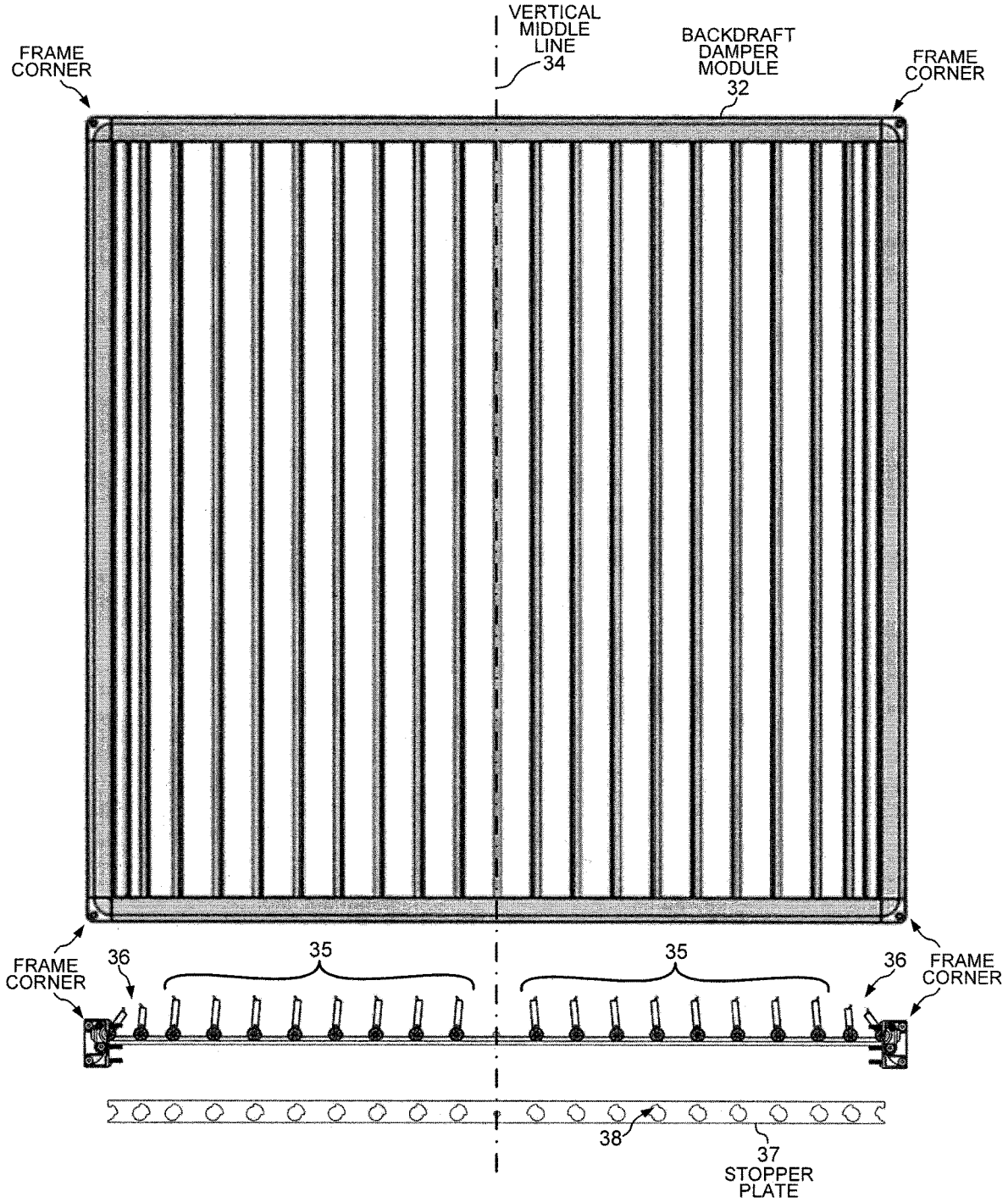
FIG. 6 is a front view of the backdraft damper module of FIG. 5 showing the twenty damper blades arranged at symmetrical locations on either side of a vertical middle line through the backdraft damper module.

FIG. 6 is a front view of the backdraft damper module 32 showing the twenty vertically oriented damper blades arranged at symmetrical locations on either side of the vertical middle line 34 through the backdraft damper module. Module 32 is shown in FIG. 6 with the damper blades in the open orientation. The 48-inch damper module 32 is made using sixteen 2.5-inch wide blades 35 and four 2-inch wide blades 36. The four 2-inch wide blades 36 are disposed farther from the middle line 34, and the sixteen 2.5-inch wide blades 35 are disposed closer to the middle line 34.

Below the front view of the backdraft damper module 32, FIG. 6 includes a view of the twenty damper blades of module 32 looking down from above with the upper damper frame side removed. A frame corner is shown on either side of the blades. The missing upper damper frame side would be attached to the frame corners by bolts. The 2-inch wide blades 36 are arranged closer to the frame corners, and the 2.5-inch wide blades 35 are arranged closer to the middle line 34. The blades to the right of middle line 34 close by rotating counter-clockwise, and the blades to the left of middle line 34 close by rotating clockwise.

FIG. 6 also shows a stopper plate 37 that is integrated into the upper damper frame side. A stopper 38 within the cutout shape in the stopper plate for each damper blade restricts the allowed rotation of each blade. The cutout shape for each blade to the right of middle line 34 prevents the blade from rotating clockwise past about 355 degrees (where 360 degrees points to 12 o'clock), and the cutout shape for each blade to the left of middle line 34 prevents the blade from rotating counter-clockwise past about five degrees. The stoppers 38 prevent the damper blades from being deflected in the incorrect direction by air moving backwards from the fan to the backdraft damper module 32.

Figure 7:
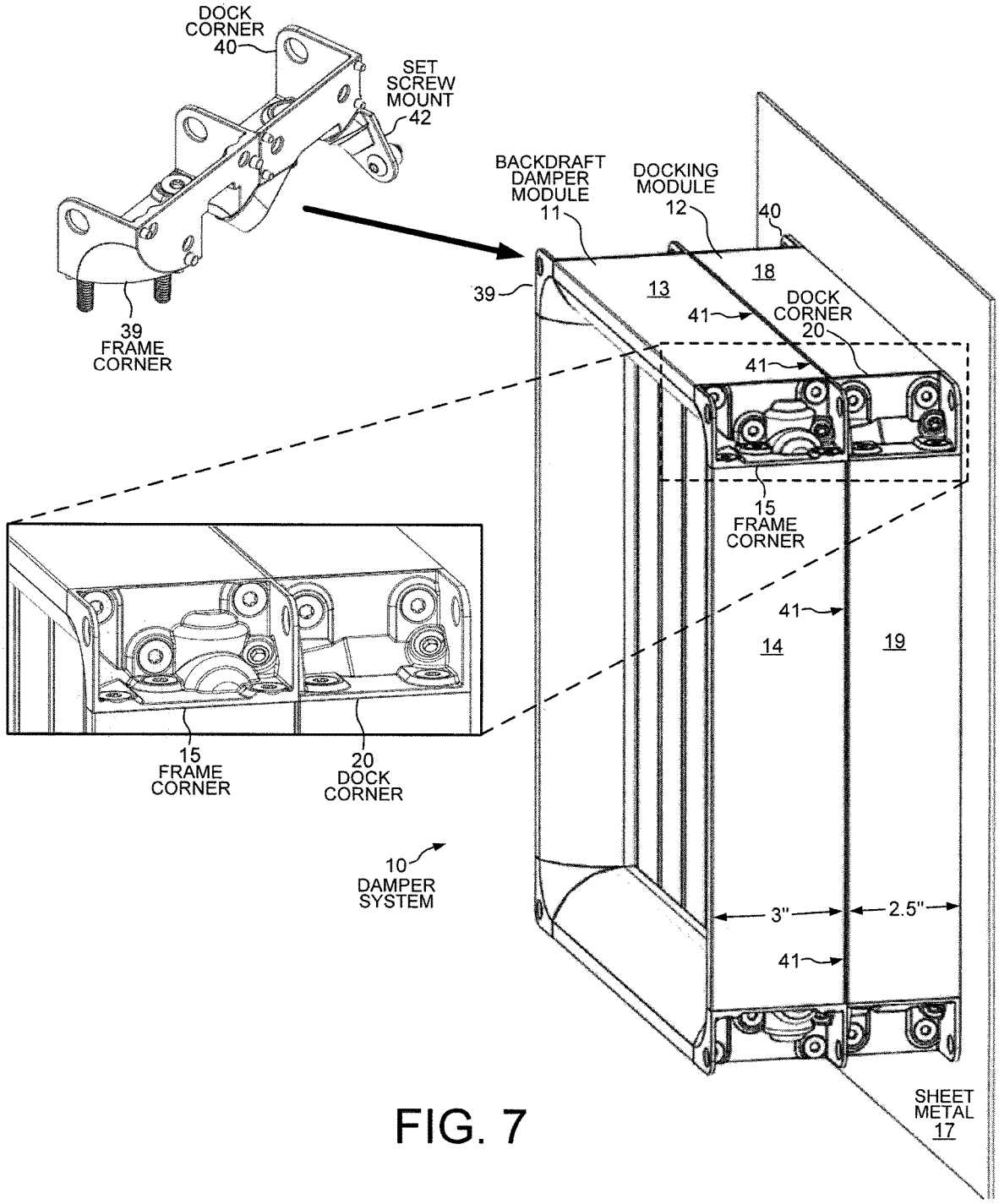
FIG. 7 is a perspective view from the side of the damper system of FIG. 2 illustrating how the backdraft damper module is attached to the docking module 12, and how the docking module is attached to the sheet metal plate of a fan assembly.

FIG. 7 is a perspective view of damper system 10 from the side illustrating how backdraft damper module 11 is attached to docking module 12, and how docking module 12 is attached to the plate of sheet metal 17 of a fan assembly. The frame of the backdraft damper module 11 includes the first damper frame side 13 on the top, which is attached between the first frame corner 15 and an opposite frame corner 39. The frame of the backdraft damper module 11 is three inches wide. The frame of the docking module 12 includes the first dock frame side 18 on the top, which is attached between the dock corner 20 and an opposite dock corner 40. The dock corner 20 connects the first dock frame side 18 to the second dock frame side 19 at a right angle. A docking plane is defined by front edges 41 of the first dock frame side 18 and the second dock frame side 19. The frame of the docking module 12 has a width of two and a half inches or less. The damper system 10 is 5.5 inches or less wide and provides a relatively low profile assembly to house the damper blades 16, but yet provides sufficient offset between the open blades and the fan assembly.

FIG. 7 also includes an enlarged view of the opposite frame corner 39 and the opposite dock corner 40, which are connected together. In addition, the enlarged view shows a set screw mount 42 to which the opposite dock corner 40 is attached. The set screw mount 42 is attached to the sheet metal 17, although this is not apparent from the view of FIG. 7.

Figure 8:
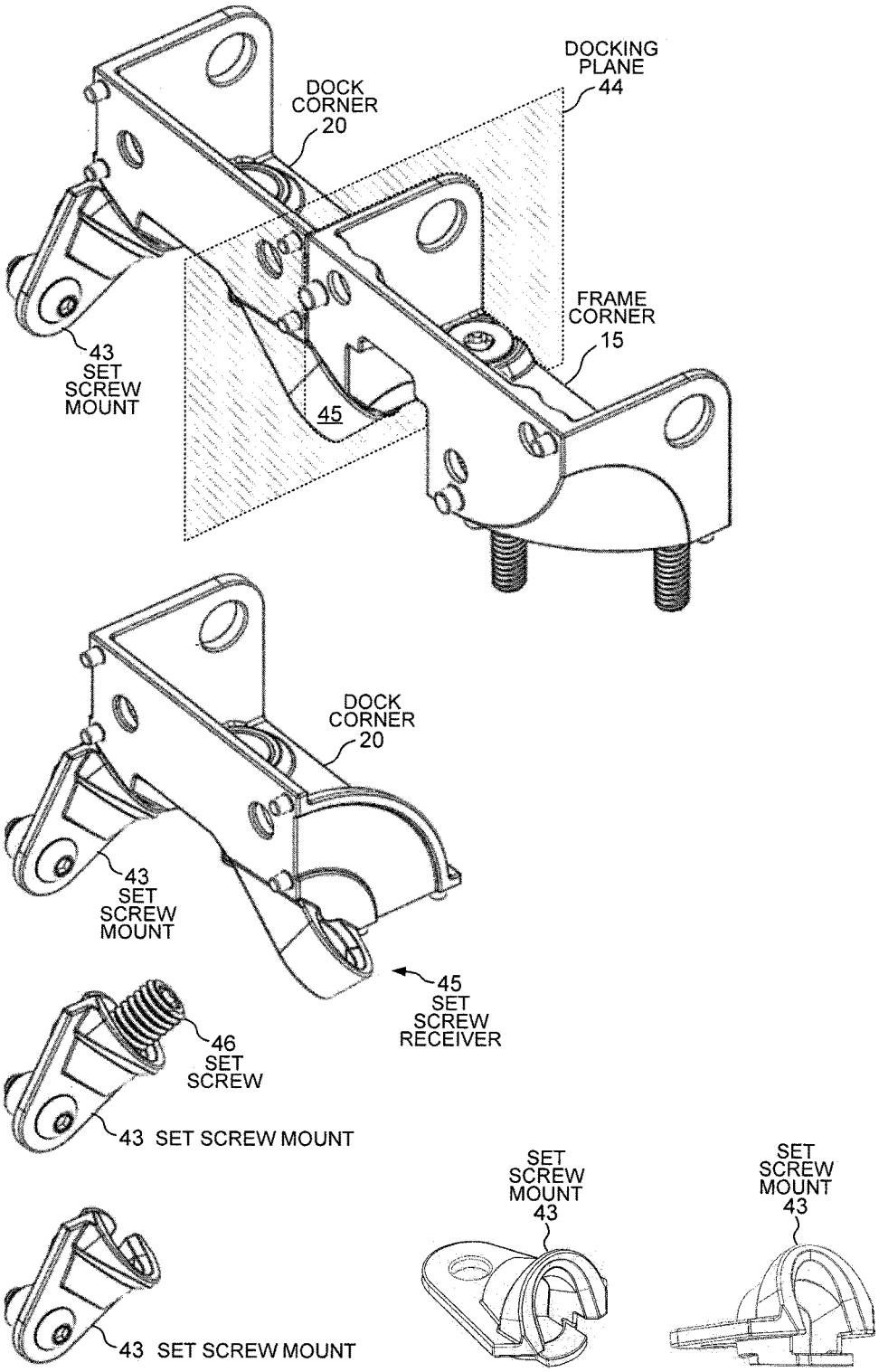
FIG. 8 is a more detailed perspective view of the first frame corner, the dock corner, and the set screw mount, which attach the damper system to the fan.

FIG. 8 is a more detailed perspective view of the first frame corner 15, the dock corner 20, and a set screw mount 43, which are connected together. The first frame corner 15 is shown with bolts that attach the corner to the second damper frame side 14. The first frame corner 15, the dock corner 20, and the set screw mount 43 are a mirror image of the opposite frame corner 39, the opposite dock corner 40, and the set screw mount 42 shown in FIG. 7. Both set screw mount 42 and set screw mount 43 are attached to the sheet metal 17. FIG. 8 shows the location of the docking plane 44 that passes between docking module 12 and backdraft damper module 11. FIG. 8 also shows a set screw receiver 45 on dock corner 20. The set screw receiver 45 protrudes past the docking plane 44 and into the backdraft damper module 11. A first set screw (not visible in FIG. 8) passes through the first frame corner 15 and has a first axis that is not parallel to the docking plane 44. The first set screw enters into the set screw receiver 45 and attaches the first frame corner 15 to the dock corner 20. By turning the first set screw, the screw can be extended from the first frame corner 15 so that it enters the set screw receiver 45.

In addition, a second set screw 46 passes through the dock corner 20 and has a second axis that is not parallel to the docking plane 44. The second set screw 46 attaches the dock corner 20 to the set screw mount 43. The second set screw 46 is shown in FIG. 8 entering the set screw mount 43. By turning the set screw 46, the set screw can be extended from the dock corner 20 so that it enters the set screw mount 43. The slanted angle of the axis of the set screw 46 compared to the docking plane 44 makes it easier to reach the screw with a screw driver or Allen wrench. FIG. 8 also shows set screw mount 43 from two additional perspectives. A flat bottom portion of the set screw mount 43, as shown in the lower right perspective, extends through a hole in the sheet metal 17 to the opposite side when set screw mount 43 is attached to the sheet metal.

Figure 9A:
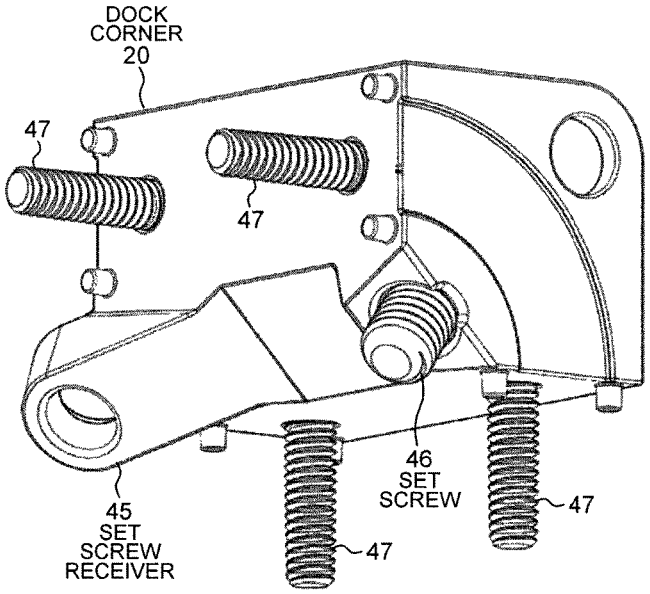
FIG. 9A is a more detailed perspective view of the dock corner from below.
Figure 9B:
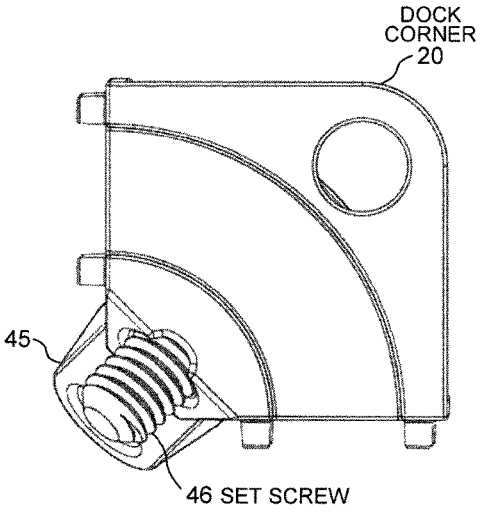
FIG. 9B is a side view of the dock corner from the side that faces the sheet metal plate.
Figure 9C:
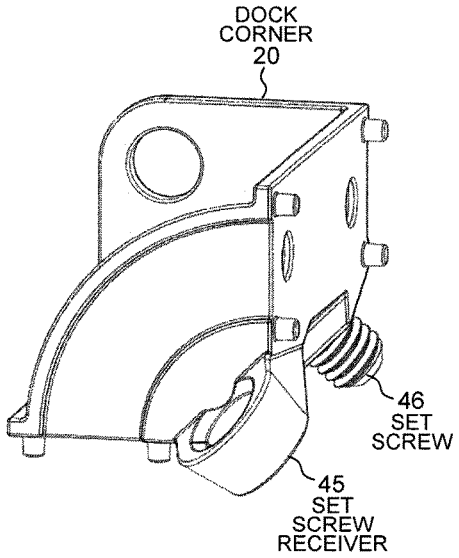
FIG. 9C is a side view of the dock corner from the side that faces the first frame corner.
Figure 9D:
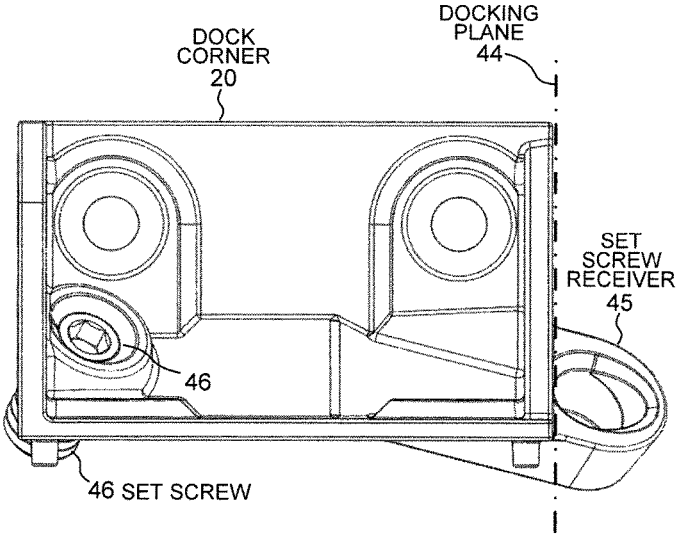
FIG. 9D shows the set screw receiver that protrudes out beyond a docking plane defined by the front edges of the dock frame sides.

FIGS. 9A, 9B, 9C and 9D show more detailed views of the dock corner 20 from four perspectives. FIG. 9A is a perspective view of the dock corner 20 from below showing four bolts 47 used to attach the dock corner to the first dock frame side 18 and the second dock frame side 19. The views of FIGS. 9B, 9C and 9D do not show the attaching bolts 47. FIG. 9A also shows the second set screw 46 extending out at a diagonal from the body of the dock corner 20. The second set screw 46 fits into the set screw mount 43. FIG. 9B is a side view of the dock corner 20 from the side that faces the sheet metal 17 and that attaches to the set screw mount 43. FIG. 9C is a side view of the dock corner 20 from the side that faces the first frame corner 15 and from which the set screw receiver 45 extends. FIG. 9D shows the set screw receiver 45 that protrudes out beyond the docking plane 44 that is defined by the front edges 41 of the dock frame sides. The set screw receiver 45 also protrudes past the damper plane that passes between the docking module 12 and the backdraft damper module 11 and thus protrudes into the backdraft damper module. A first set screw that extends from the first frame corner 15 fits into the set screw receiver 45 and attaches the first frame corner 15 to the dock corner 20. FIG. 9D also shows the end of the second set screw 46 from the inside of the body of the dock corner 20. The end of the second set screw 46 has a slot that can be turned by an Allen wrench in order to extend and retract the screw.

Figure 10A:
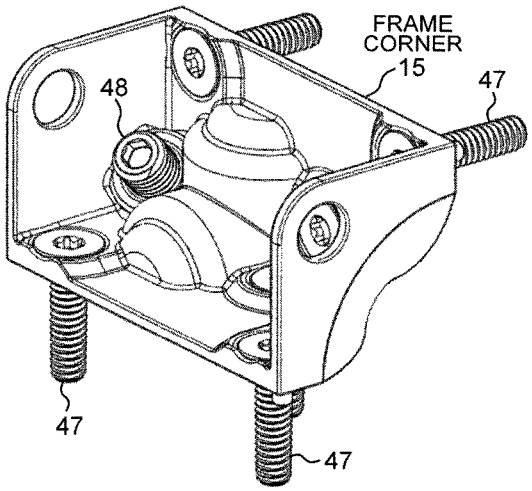
FIG. 10A is a more detailed perspective view of the first frame corner showing the six bolts used to attach the first frame corner to the first damper frame side and the second damper frame side.
Figure 10B:
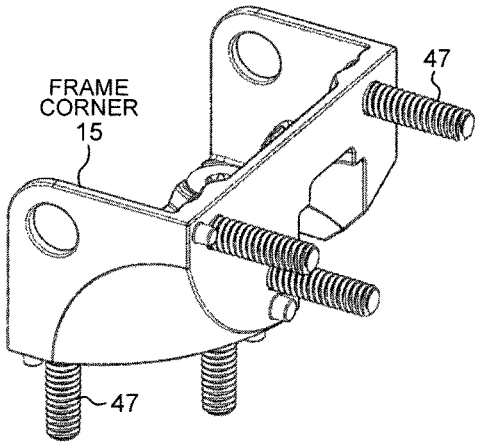
FIG. 10B shows the first frame corner from the side that faces the dock corner.
Figure 10C:
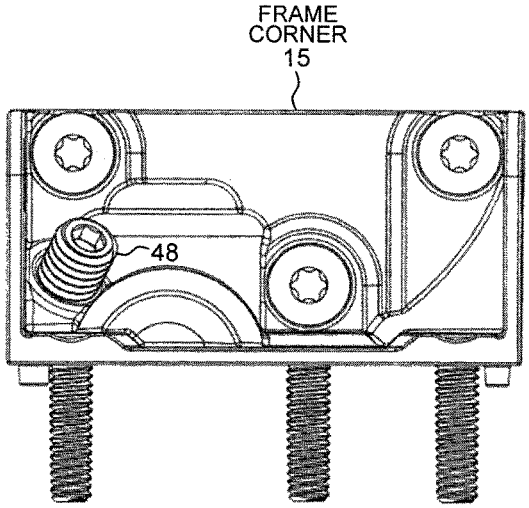
FIG. 10C is a view of the back of the first frame corner showing the first set screw.
Figure 10D:
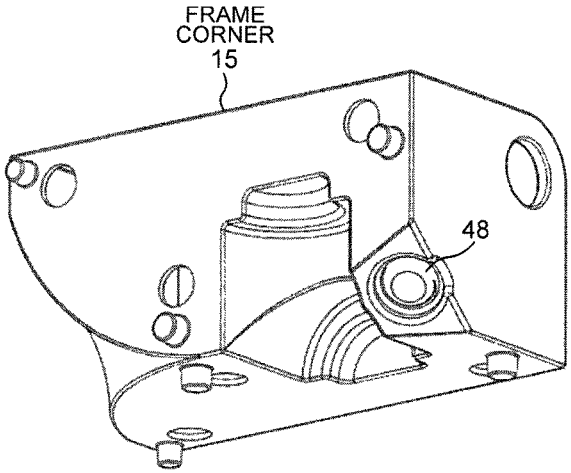
FIG. 10D is a perspective view of the first frame corner from below without the six attaching bolts.

FIGS. 10A, 10B, 10C and 10D show more detailed views of the first frame corner 15 from four perspectives. FIG. 10A is a perspective view showing the inside of the body of the first frame corner 15 and the first set screw 48. FIG. 10A also shows the six bolts 47 used to attach the first frame corner 15 to the first damper frame side 13 and the second damper frame side 14. The views of FIGS. 10B and 10C also show the attaching bolts 47, but the view of FIG. 10D does not. FIG. 10B is a perspective view of the first frame corner 15 from the side that faces the dock corner 20. FIG. 10C is a view of the back of the first frame corner 15 showing the first set screw 48, which has not been screwed in sufficiently to extend the screw out the bottom corner of the first frame corner 15. FIG. 10C shows the slot in the end of the first set screw 48 that can be turned by an Allen wrench in order to extend and retract the screw. When the first set screw 48 is extended from the first frame corner 15, it fits into the set screw receiver 45 of the dock corner 20. FIG. 10D is a perspective view of the first frame corner 15 from below without showing the six attaching bolts 47. The bottom end of the first set screw 48 is shown barely protruding from the bottom corner of the first frame corner 15.

Figure 11A:
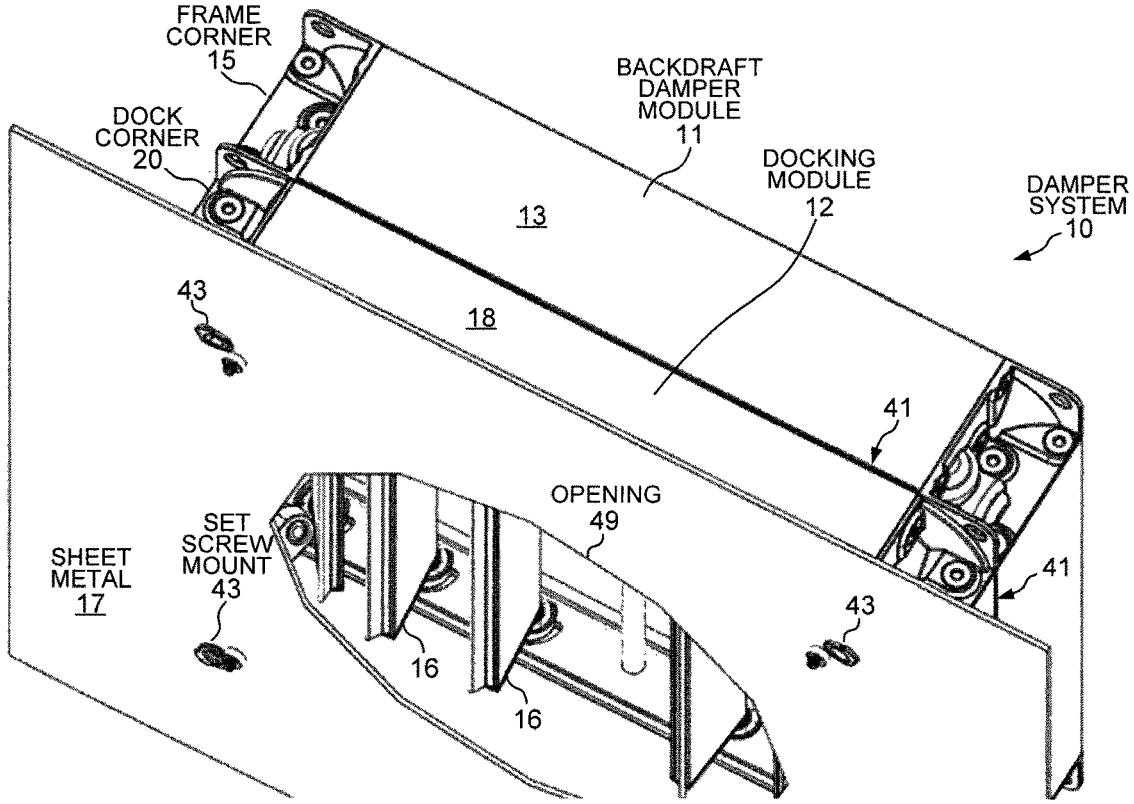
FIG. 11A shows the back side of the damper system of FIG. 2 with a round opening in the sheet metal plate through which open damper blades are visible.
Figure 11B:
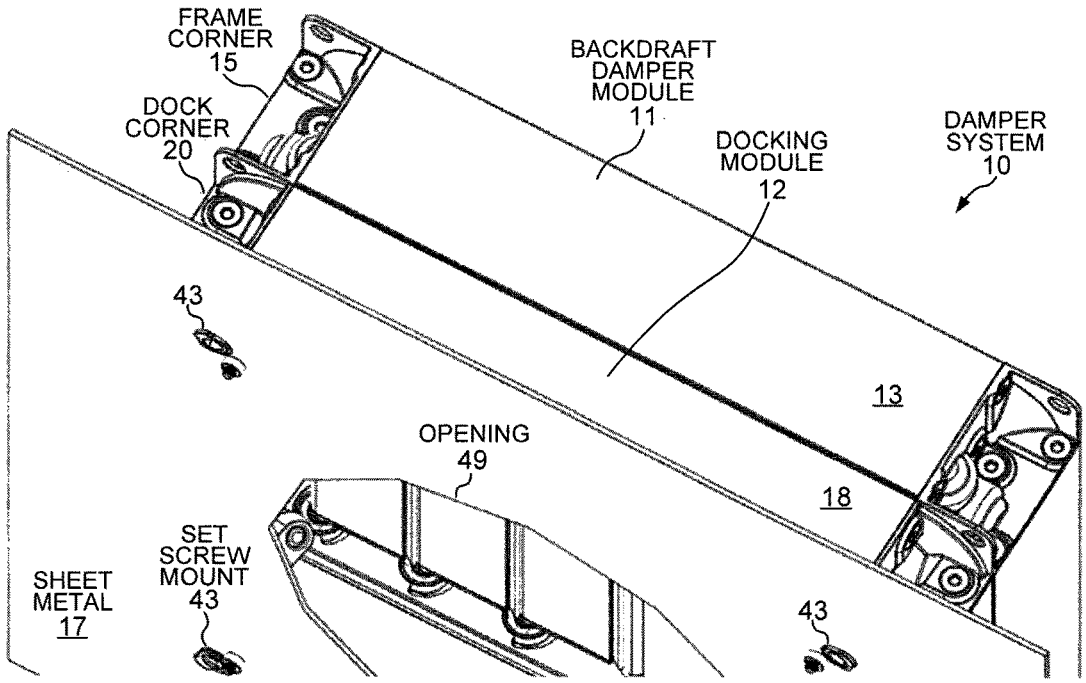
FIG. 11B shows the back side of the damper system of FIG. 2 with a round opening in the sheet metal plate through which closed damper blades are visible.

FIGS. 11A and 11B are perspective views of damper system 10 showing the back side of the plate of sheet metal 17 and a circular or round opening 49 in the sheet metal through which the air is drawn by the fan. FIGS. 11A and 11B show the flat bottom portions of the set screw mounts 43 that extend through holes in the sheet metal 17 to the back side in order to attach the set screw mounts 43 to the sheet metal. In FIG. 11A, the damper blades 16 can be seen in an open orientation through the opening 49. FIG. 11B shows the damper blades in a closed orientation.

Because fan assemblies are typically mounted to plates that have round openings corresponding to the circular orbit of the spinning fan blades, such as the opening 49 shown in FIG. 11A, the damper blades 16 must be offset from the sheet metal of the fan plate so that the blades 16 are not hindered from rotating to an open orientation by the sheet metal surrounding the round hole, which is smaller than the square frame. The docking module 12 provides the spacing or offset from the sheet metal 17 that is required to allow the damper blades 16 to rotate to their open orientation. In damper system 10, the damper blades 16 have a width of two inches, and the backdraft damper module 11 has a width of three inches. Therefore, when the damper blades 16 pivot into an open orientation from the middle of the 3-inch wide damper, as shown in FIG. 11A, the blades extend beyond the back of the damper by about one half inch. This illustrates one reason why the extra spacing provided by the docking module 12 is required.

Figure 12:
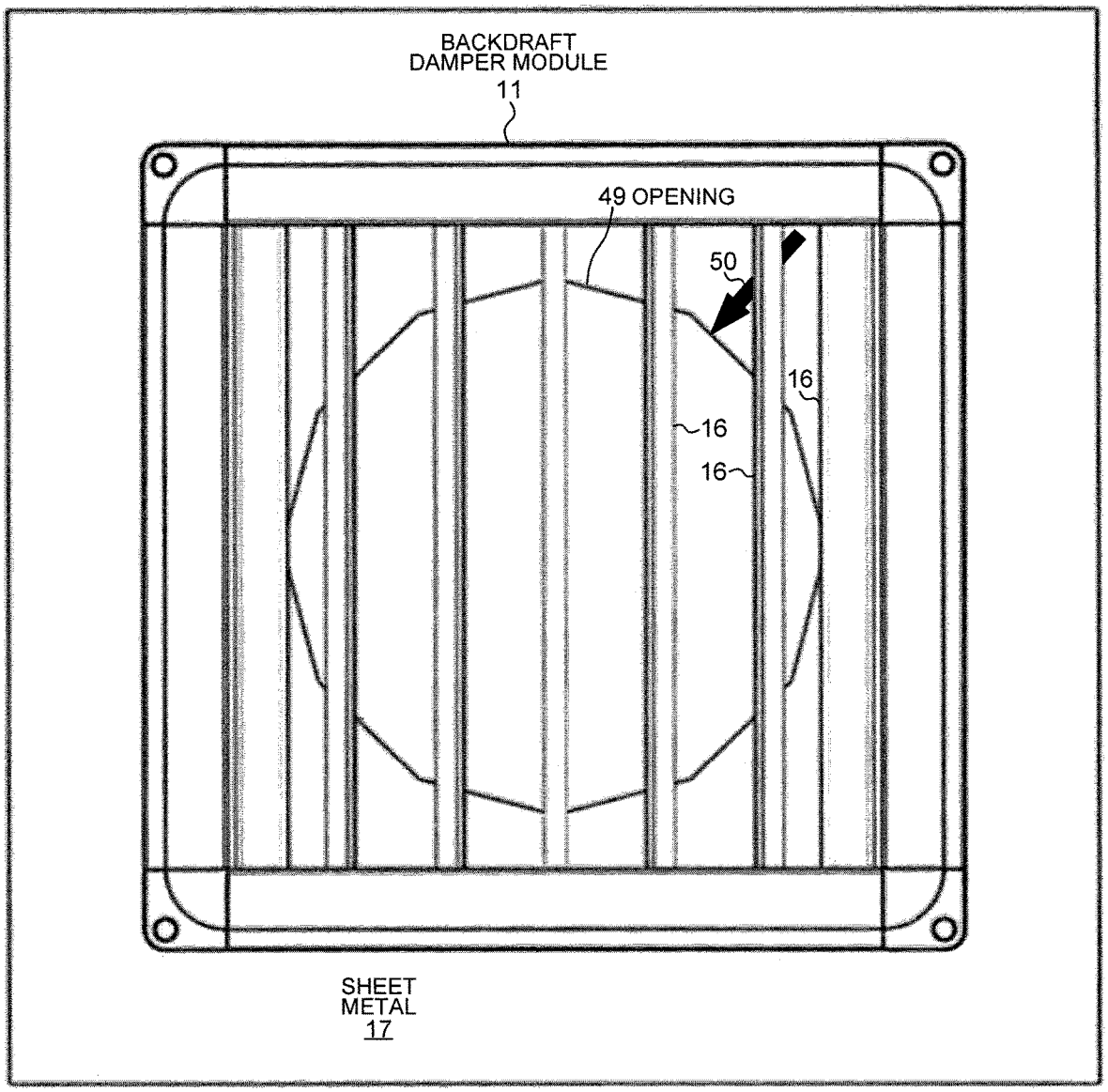
FIG. 12 is a front view of the backdraft damper module illustrating how the air that enters at a corner of the square damper frame must move in order to pass through the smaller round opening.

Another reason for providing some setoff distance between the damper blades 16 and the opening 49 is to allow the air to flow straighter through the blades at the edges of the frame of the backdraft damper module 11 and to reduce the amount of turbulence as the air flow at the edges of the larger square frame must curve in order to pass through the smaller round opening 49. FIG. 12 illustrates how the air that enters the backdraft damper module 11 at a corner of the square frame must move in a direction that is not straight through the damper blades 16 in order to pass through the smaller round opening 49. Arrow 50 illustrates that air entering the damper at the upper right corner of the frame must move diagonally down and to the left in order to pass through the opening 49. This creates turbulence in the air flow. Turbulence is reduced if the air flow at the edges can change its course less abruptly over a larger distance, such as the setoff distance provided by the docking module 12. In addition, a faster air flow requires a larger distance to change its course without generating a large amount of turbulence. For an air handling system that moves air at a very high flow rate through the damper system 10, multiple docking modules can be used to increase the distance between the damper blades 16 and the opening 49 to the fan assembly.

Figure 13:
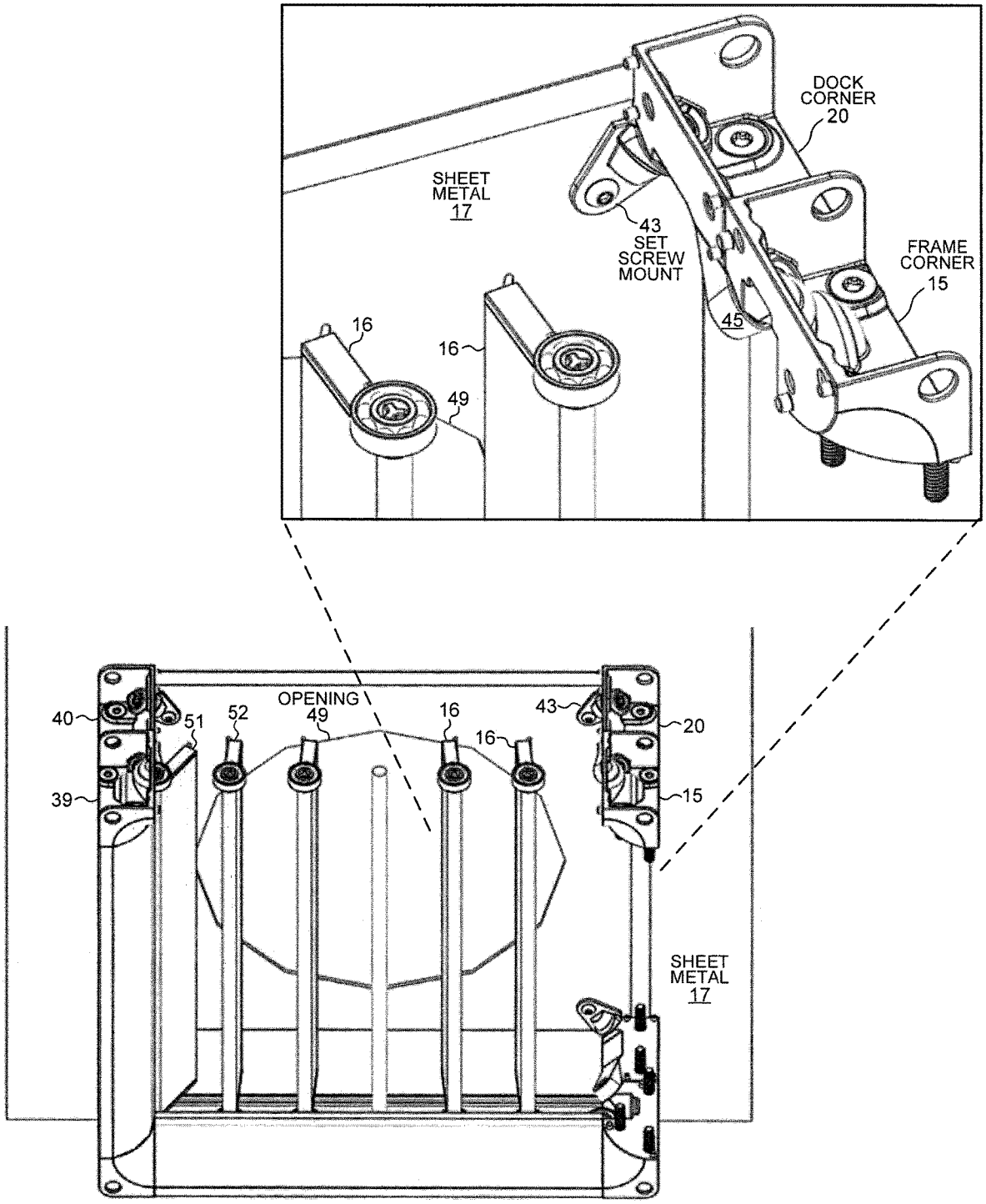
FIG. 13 is a front perspective view of a damper system with the top frame sides of the damper and dock removed for a better view of how a frame corner and dock corner are attached by a set screw mount to a sheet metal plate.

FIG. 13 is a front perspective view of damper system 10 from which the first damper frame side 13 of damper 11 and the first dock frame side 18 of dock 12 have been removed for a better view of the damper blades 16 and how frame corner 15 and dock corner 20 are attached by set screw mount 43 to the sheet metal 17. The damper blade on the far right has also been removed to provide a better view of the frame corners, the dock corners and the set screw mounts on the right side of the damper system 10. In FIG. 13, the damper blades 16 are in an open orientation. However, the blades are not all parallel to each other but rather are directed towards the opening 49. For example, the damper blade 51 on the far left is rotated at a larger angle to the right (and towards the opening 49) than is the damper blade 52 to its right. Thus, the blades are aligned with the air flow that is being pulled through the opening 49. The damper blades 16 remain aligned with the air currents through the damper without creating any significant drag on the air flow. The modular damper system 10 causes a resistive loss to air flow of less than a quarter inch of water gauge pressure for 2,000 cubic feet per minute (cfm) of air flowing through the 12-inch by 12-inch damper system. The damper blades 16 are then closed by air moving backwards through the damper, for example, if the fan malfunctions.

Figure 14:
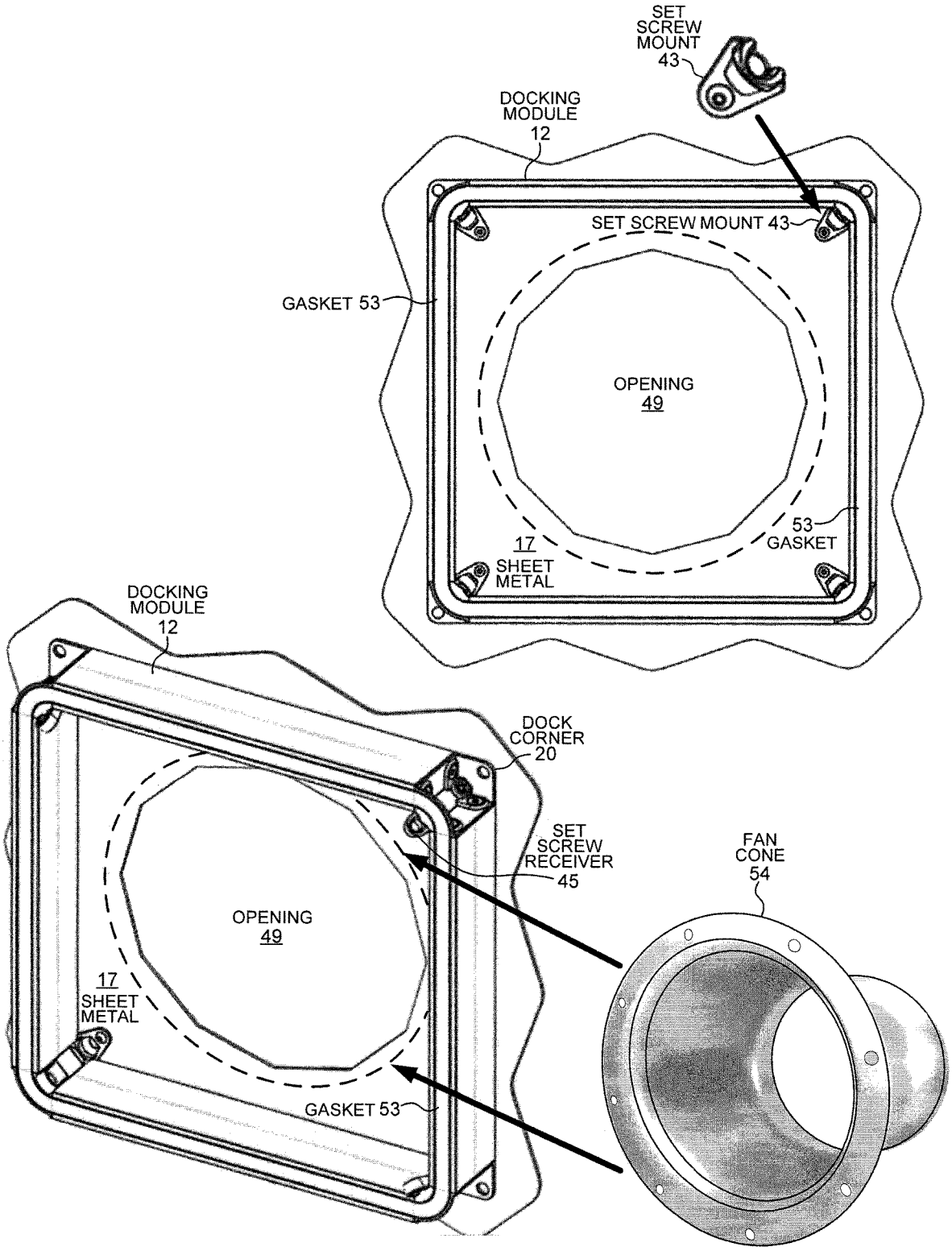
FIG. 14 shows a gasket in the frame of a docking module that is attached by set screw mounts to a sheet metal plate of a fan assembly.

FIG. 14 shows the docking module 12 that is attached by four set screw mounts to the sheet metal plate of the fan assembly. Four set screws pass through four dock corners and are screwed into the four set screw mounts. The axes of the set screws are slanted away from the docking plane to provide easier access by a screw driver or Allen wrench. FIG. 14 also shows the set screw receiver 45 of the dock corner 20. Set screw receiver 45 protrudes past the docking plane and the damper plane into the backdraft damper module 11 (not shown in FIG. 14). A set screw from the frame corner 15 is then screwed into the set screw receiver 45 of the dock corner 20 to secure the backdraft damper module 11 to the docking module 12. FIG. 14 also shows a gasket 53 disposed between the frame of the docking module 12 and the frame of the backdraft damper module 11. The gasket 53 makes an airtight seal between the dock frame and the damper frame so that when the blades of the backdraft damper module 11 are closed, there is no leakage of air coming from the fan out of the modular damper system 10.

FIG. 14 also shows an exemplary fan cone 54 that can be inserted into the opening 49 and attached by a flange to the sheet metal 17 around the opening. The dashed circle around the opening 49 illustrates the boundary of the flange of the fan cone 54 after it is attached to the sheet metal 17. The fan cone 54 allows the air to be more smoothly drawn from the opening 49 to the rotating blades of the fan.

Although certain specific exemplary embodiments are described above in order to illustrate the invention, the invention is not limited to the specific embodiments.

Accordingly, various modifications, adaptations, and combinations of various features of the described embodiments can be practiced without departing from the scope of the invention as set forth in the claims.

What is claimed is:

1. A damper system, comprising:

a backdraft damper module comprising:

a first damper frame side;

a second damper frame side oriented perpendicular to the first damper frame side, wherein a damper plane is defined by rear edges of the first damper frame side and the second damper frame side; and a first frame corner disposed adjacent to a first end of the first damper frame side and adjacent to a second end of the second damper frame side, wherein a first set screw passes through the first frame corner and has a first axis that is neither parallel nor orthogonal to the damper plane; and a docking module comprising:

a first dock frame side;

a second dock frame side oriented perpendicular to the first dock frame side, wherein a docking plane is defined by front edges of the first dock frame side and the second dock frame side, wherein the docking plane is parallel to and adjacent to the damper plane; and a second frame corner disposed adjacent to a third end of the first dock frame side and adjacent to a fourth end of the second dock frame side, wherein the second frame corner has a set screw receiver that protrudes past the damper plane into the backdraft damper module, and wherein the first set screw enters into the set screw receiver.

2. The damper system of claim 1, wherein the backdraft damper module further comprises vertically oriented damper blades, wherein the damper blades are adapted to rotate into an open orientation and a closed orientation, and wherein portions of the damper blades extend beyond the damper plane when the damper blades are in the open orientation.

3. The damper system of claim 2, wherein there are an even number of damper blades, and wherein the damper blades are arranged at symmetrical locations on either side of a vertical middle line through the backdraft damper module.

4. The damper system of claim 2, wherein the first set screw is adapted to be retracted from the set screw receiver.

5. A damper system, comprising:

a backdraft damper module comprising:

a first damper frame side;

a second damper frame side oriented perpendicular to the first damper frame side, wherein a damper plane is defined by rear edges of the first damper frame side and the second damper frame side; and a first frame corner disposed adjacent to a first end of the first damper frame side and adjacent to a second end of the second damper frame side, wherein a first set screw passes through the first frame corner and has a first axis that is not parallel to the damper plane; and a docking module comprising:

a first dock frame side;

a second dock frame side oriented perpendicular to the first dock frame side, wherein a docking plane is defined by front edges of the first dock frame side and the second dock frame side, wherein the docking plane is parallel to and adjacent to the damper plane; and a second frame corner disposed adjacent to a third end of the first dock frame side and adjacent to a fourth end of the second dock frame side, wherein the second frame corner has a set screw receiver that protrudes past the damper plane into the backdraft damper module, and wherein the first set screw enters into the set screw receiver, and a set screw mount attached to sheet metal, wherein a second set screw passes through the second frame corner and has a second axis that is not parallel to the docking plane, and wherein the second set screw enters into the set screw mount.

6. The damper system of claim 5, wherein a fan is attached to the sheet metal.

7. The damper system of claim 6, wherein the backdraft damper module further comprises vertically oriented damper blades, and wherein the backdraft damper module is adapted to allow air drawn by the fan to flow through the damper blades.

8. The damper system of claim 5, wherein the docking module is mounted over a circular opening in the sheet metal.

9. The damper system of claim 5, wherein the second axis is parallel to the first axis.

10. A device comprising:

a frame of a backdraft damper, wherein the frame includes a first side, a second side and a corner piece, wherein the corner piece is attached to the first side and to the second side, wherein the first side is perpendicular to the second side, wherein a damper plane is defined by rear edges of the first side and the second side, and wherein a set screw passes through the corner piece and has an axis that is neither parallel nor orthogonal to the damper plane;

a plurality of damper blades oriented vertically in the frame of the backdraft damper, wherein the damper blades are adapted to rotate into an open orientation and a closed orientation, and wherein portions of the damper blades extend beyond the damper plane when the damper blades are in the open orientation; and a dock frame that includes a third side, a fourth side and a dock corner, wherein the dock corner is attached to the third side and to the fourth side, wherein the third side is perpendicular to the fourth side, wherein a dock plane is defined by front edges of the third side and the fourth side, wherein the damper plane is parallel to the dock plane, wherein the dock corner has a set screw receiver that extends past the dock plane into the damper plane, and wherein the set screw enters into the set screw receiver.

11. The device of claim 10, wherein the set screw is adapted to be retracted such that the set screw no longer enters into the set screw receiver.

12. The device of claim 10, wherein the dock frame has a width of two and a half inches or less.

13. The device of claim 10, further comprising:

a gasket disposed between the dock frame and the frame of the backdraft damper.

14. The device of claim 10, wherein the frame of the backdraft damper includes a second corner piece attached to the first side opposite the corner piece, and wherein a second set screw passes through the second corner piece.

15. The device of claim 10, wherein gravitational force does not move the plurality of damper blades into the open orientation or into the closed orientation.

16. A device comprising:

a frame of a backdraft damper, wherein the frame includes a first side, a second side and a corner piece, wherein the corner piece is attached to the first side and to the second side, wherein the first side is perpendicular to the second side, wherein a damper plane is defined by rear edges of the first side and the second side, and wherein a set screw passes through the corner piece and has an axis that is not parallel to the damper plane;

a plurality of damper blades oriented vertically in the frame, wherein the damper blades are adapted to rotate into an open orientation and a closed orientation, and wherein portions of the damper blades extend beyond the damper plane when the damper blades are in the open orientation;

a dock frame that includes a third side, a fourth side and a dock corner, wherein the dock corner is attached to the third side and to the fourth side, wherein the third side is perpendicular to the fourth side, wherein a dock plane is defined by front edges of the third side and the fourth side, wherein the damper plane is parallel to the dock plane, wherein the dock corner has a set screw receiver that extends past the dock plane into the damper plane, and wherein the set screw enters into the set screw receiver; and a set screw mount attached to sheet metal, wherein a second set screw passes through the dock corner and has a screw axis that is not parallel to the dock plane, and wherein the second set screw enters into the set screw mount.

17. The device of claim 16, wherein the sheet metal is attached to a fan.

18. The device of claim 17, wherein the frame of the backdraft damper is adapted to allow air drawn by the fan to flow through the plurality of damper blades.

19. The device of claim 16, wherein the dock frame is mounted over a circular opening in the sheet metal.

20. The device of claim 16, wherein the screw axis is parallel to the axis of the set screw.

* * * * *